US006424312B2

(12) United States Patent
Mangenot et al.

(10) Patent No.: US 6,424,312 B2
(45) Date of Patent: Jul. 23, 2002

(54) RADIATING SOURCE FOR A TRANSMIT AND RECEIVE ANTENNA INTENDED TO BE INSTALLED ON BOARD A SATELLITE

(75) Inventors: Cyril Mangenot; Yann Cailloce, both of Toulouse; Jacques Maurel, Cugnaux, all of (FR)

(73) Assignee: Alcatel, Paris (FR)

( * ) Notice: Subject to any disclaimer, the term of this patent is extended or adjusted under 35 U.S.C. 154(b) by 8 days.

(21) Appl. No.: 09/730,832

(22) Filed: Dec. 7, 2000

(30) Foreign Application Priority Data

Dec. 9, 1999 (FR) ..... 99 15527

(51) Int. Cl.[7] ..... H01Q 19/12
(52) U.S. Cl. ..... 343/840; 343/781 R; 343/786
(58) Field of Search ..... 343/754, 776, 343/786, 840, 781 R, 781 P, 781 CA

(56) References Cited

U.S. PATENT DOCUMENTS

| | | | | |
|---|---|---|---|---|
| 3,633,208 A | | 1/1972 | Ajioka | 343/786 |
| 4,090,203 A | | 5/1978 | Duncan | 343/753 |
| 4,855,751 A | | 8/1989 | Ingerson | 343/779 |
| 5,517,203 A | * | 5/1996 | Fiedziuszko | 343/756 |
| 6,211,842 B1 | * | 4/2001 | Cousin et al. | 343/840 |
| 6,255,997 B1 | * | 7/2001 | Ratkorn et al. | 343/832 |
| 6,268,835 B1 | * | 7/2001 | Toland et al. | 343/781 P |
| 6,271,799 B1 | * | 8/2001 | Rief et al. | 343/776 |

OTHER PUBLICATIONS

P.J.B. Clarricoats et al, "An Array–Fed Reconfigurable Reflector for Flexible Coverage" Proceedings Of The European Microwave Conference, GB, Tunbridge Wells, Reed Exhibition Company, Sep. 6, 1993, pp. 194–197 XP000629912.

* cited by examiner

*Primary Examiner*—Tan Ho
(74) *Attorney, Agent, or Firm*—Sughrue Mion, PLLC

(57) ABSTRACT

The invention relates to a radiating source for transmitting and receiving, intended to be installed on board a satellite to define a radiation pattern in a terrestrial zone, said source being intended to be disposed in or near the focal plane of a reflector associated with other sources corresponding to other terrestrial zones. The source includes a plurality of radiating apertures, each of which has an efficiency at least equal to 70%, and feed means for feeding said radiating apertures. The radiating apertures and their feed means are such that the energy radiated by all of the radiating apertures is practically limited to the corresponding reflector, at least for transmission.

15 Claims, 2 Drawing Sheets

RADIATING SOURCE FOR A TRANSMIT AND RECEIVE ANTENNA INTENDED TO BE INSTALLED ON BOARD A SATELLITE

The invention relates to a transmit and receive antenna on board a satellite forming part of a telecommunications system in which said antenna relays calls in a terrestrial region divided into a plurality of zones. The region is divided into zones by allocating to each zone a primary source consisting of individual radiating entities that can be common to a plurality of sources.

BACKGROUND OF THE INVENTION

Compared to global coverage, dividing the region covered by the satellite into zones has the advantage that energy performance is improved and frequencies can be re-used from one zone to another. For example, the allocated frequency band can be divided into a plurality of sub-bands and the sub-bands can be distributed so that two adjacent zones use different sub-bands.

A region covered by a satellite is divided into zones both for geosynchronous satellites and for non-geosynchronous satellites. The following description is limited to a geosynchronous satellite telecommunications system, but the invention also applies to a non-geosynchronous satellite system for communicating with mobiles.

The example mainly considered will be that of a Ka band telecommunications system for high bit rate multimedia services. In the Ka band, the transmit frequency is 20 GHz and the receive frequency is 30 GHz. These high frequency values enable the use of relatively compact equipment both on board the satellite and on the ground, and therefore reduce costs, which in the case of the terrestrial equipment is beneficial from the point of view of mass production.

A typical geosynchronous satellite telecommunications system covers a region "seen" by the satellite within a total angle of approximately 6°, and the region is divided into about 40 to about 100 zones. In this system, each zone is formed by a linearly (or circularly) polarized beam which is highly directional, having a directionality of the order of 45 dBi at the edge of the coverage zone, the frequency band is divided into four sub-bands, and the secondary lobes of each beam must have a low level relative to the main lobe in order to limit interaction between zones using the same frequency. It is generally accepted that the level of the secondary lobes must be at least 25 dB below the level of the main lobe.

The large number of zones for the same region leads to a large number of primary sources, which is not beneficial in terms of minimizing the mass and the volume of the equipment on board the satellite.

The equipment on board the satellite includes reflectors, each of which is associated with a plurality of primary sources, and each source corresponds to a terrestrial zone, but is able to contribute to the generation of several zones. Thus FIG. 1 is a diagram showing a reflector 10 in whose focal plane 12 there are a plurality of primary sources, only two of which are shown, namely the sources 14 and 16. The source 14 transmits or receives a beam whose edge rays are denoted $\mathbf{14}_1$ and $\mathbf{14}_2$ in FIG. 1. The primary source 16 transmits or receives a beam whose edge rays are denoted $\mathbf{16}_1$ and $\mathbf{16}_2$. Each of the beams $\mathbf{14}_1$, $\mathbf{14}_2$ and $\mathbf{16}_1$, $\mathbf{16}_2$ forms a terrestrial zone with a diameter of at least 100 kilometers. The diameter of the reflector 10 is of the order of 1 meter or 1.5 meters and it is therefore sufficient for each beam to have an aperture of a few tenths of a degree to obtain the corresponding relationship between the primary source, the reflector and the terrestrial zone, for transmission in particular.

Because each primary source 14, 16 is of non-negligible overall size, each reflector 10 is associated with primary sources corresponding to distant zones. The greater the distance between the terrestrial zones, the greater the distance required between the primary sources 14, 16, also referred to as the pitch. Accordingly, as a general rule, the primary sources associated with two adjacent zones are allocated to different reflectors. In one example, one-fourth of the primary transmit and/or receive sources are allocated to each reflector.

It is therefore clear from the FIG. 1 diagram that the distance on the ground between terrestrial zones conditions the distance between radiating sources 14, 16 and that the dimension of each terrestrial zone conditions the diameter of the reflector 10.

The combination of the reflector and the radiating sources must satisfy two additional conditions relating to the illumination of the reflector by a primary source, over and above the conditions referred to above relating to secondary lobes:

The first condition is that the source must illuminate the periphery 20 of the reflector 10 at a sufficiently low level for the radiation not to interfere with the terrestrial zones adjoining the area to which that source is allocated.

The second condition is that the primary source must illuminate the periphery 20 of the reflector 10 at a sufficiently high level to guarantee good surface efficiency (the ratio between the actual directionality of the beam and the maximum directionality of the antenna for uniform illumination).

For example, the peripheral zone 20 must be illuminated at a level approximately 9 dB below the level of the illumination of the central zone 22 to obtain a good trade-off between these two contradictory constraints.

Finally, for each chosen circular zone to be illuminated optimally, the radiation pattern of each primary source must also be circularly symmetrical, both for transmission and for reception.

Because the radiation pattern of a source is frequency-dependent, it is different for transmission and for reception. Consequently, to comply easily with the conditions imposed on the radiating source and reflector combination as a whole, it is preferable to separate the sources provided for transmission from the sources provided for reception.

Accordingly, a routine radiating source and reflector combination includes first reflectors for the transmit sources and second reflectors for the receive sources. Although that solution complies with the constraints regarding isolation between zones and efficiency for each beam, it nevertheless has the disadvantage of leading to large overall size and high mass for the equipment on board the satellite. Also, the large number of reflectors increases the complexity of the mechanical assembly on board the satellite.

The number of reflectors on a satellite can be reduced by using the same radiating source to transmit and receive. This is known in the art.

To this end it is necessary to use wide-band sources (i.e. sources operating both in the transmit band and in the receive band). In this case, the choice of the source is in practice limited to a "corrugated" radiating aperture, i.e. one having internal ribs, because that type of source is the only one that can produce a circularly symmetrical pattern for the transmit and receive frequencies with a satisfactory reflection coefficient, also referred to as the standing wave ratio (SWR).

However, for a given directionality, a corrugated radiating aperture is of larger overall size than a narrow-band primary source (for example a Potter radiating aperture). This being the case, for a given distance between terrestrial zones allocated to the same reflector 10, a greater distance between primary sources is required, compared to the first embodiment.

Accordingly, in the FIG. 1 diagram, the sources 14 and 16 correspond to transmit (or receive) sources in the first embodiment described and the overall sizes of the transmit and receive sources 14' and 16' are increased. It can therefore be seen that in the second embodiment, because the distance between the sources is greater, the positioning of the areas on the ground no longer complies with the imposed constraints. The size of the corrugated radiating apertures must therefore be reduced, which leads to excessive illumination of the periphery 20 of the reflector 10 (generally only 3 dB below the illumination at the center 22). This excessive illumination interferes with the operation of the system and leads to energy losses.

OBJECTS AND SUMMARY OF THE INVENTION

The invention aims to provide a transmit and receive system in which each wide-band primary source is free of the disadvantages of the prior art solutions, i.e. achieves a sufficiently low level of illumination at the periphery of the transmit reflector.

Thus in an antenna of the invention each reflector is associated with a plurality of transmit and receive sources and each transmit and receive source includes a plurality of radiating apertures whose efficiency (gain) is at least equal to 70%, with individual feed means for feeding each radiating aperture able to supply different energies to two different radiating apertures in order for the illumination at the periphery of the reflector to be at a sufficiently low level for the energy radiated outside the reflector to be negligible, and preferably so that the illumination at the periphery is practically the same for all transmit and receive frequencies.

Other things being equal, and in particular the area of the reflector, for example that of a circle with a diameter of approximately 50 mm, compared to a corrugated radiating aperture, each radiating aperture, which has an efficiency of at least 70%, is more directional, which reduces the energy at the edge of the reflector. A corrugated radiating aperture has an efficiency (gain) of at most 60%.

It should be noted that, until now, it has been considered that a high-efficiency smooth conical horn radiating aperture is not suitable for this type of wide-band source because it cannot produce a circularly symmetrical radiation pattern and the radiation pattern has large secondary lobes, preventing correct isolation between zones to which the same frequency sub-bands are allocated. However, the invention overcomes at least the major part of this drawback, because the radiating sources are not very directional, compared to the source consisting of the set of apertures, and the distribution of the radiation from each high-efficiency radiating aperture reduces the overall lack of symmetry about the axis of the reflector, because it reduces the difference between the radiating levels in two planes perpendicular to each other and to the reflector.

A high-efficiency central radiating aperture and high-efficiency peripheral radiating apertures are preferably distributed regularly about the axis of the central radiating aperture, for example. In one embodiment, the power fed to a high-efficiency central radiating aperture is greater than the power fed to the high-efficiency peripheral radiating apertures and the peripheral radiating apertures are all fed with the same power.

Generally speaking, the invention provides a feed for each radiating aperture and the amplitude and the phase of each feed can be chosen at will for transmission and for reception. In other words the radiation pattern in transmission and in reception can be selected at will, thanks to the multiplicity of radiating apertures and the individual feed to each radiating aperture.

Thus it will often be of benefit to feed the radiating apertures differently for transmission and for reception.

To improve the symmetry of the radiation pattern about the axis of the reflector, or about the axis of the set of radiating apertures, according to one feature of the invention, the various radiating apertures are fed with linear polarization and the polarization is oriented relative to the disposition of the various radiating apertures to maximize the symmetry of the radiation about the axis of the radiating source. For example, if the radiating apertures are distributed so that there is a direction passing through the center of the radiating source through which a maximum number of centers of radiating apertures passes, the polarization direction perpendicular to that direction is chosen.

To prevent the lobes of the array of radiating apertures constituting the radiating source reducing the power to be transmitted in the wanted direction, the distance between the centers of the radiating apertures is less than one wavelength at the transmit frequency (the lower frequency). For example, when the transmit frequency is 20 GHz, the distance between the radiating apertures must be less than approximately 16 mm.

The present invention provides a radiating source for transmitting and receiving at different frequencies, intended to be installed on board a satellite to define a radiation pattern in a terrestrial zone, said source being intended to be disposed in or near the focal plane of a reflector associated with other sources corresponding to other terrestrial zones, the source including a plurality of radiating apertures, each of which has an efficiency at least equal to 70%, and feed means for feeding each radiating aperture, the radiating apertures and their feed means being such that the energy radiated by all of the radiating apertures is practically limited to the corresponding reflector, at least for transmission.

In an embodiment, the feed means of each radiating aperture are such that the radiation pattern is substantially the same for transmission and for reception.

In an embodiment, the source includes a central radiating aperture and peripheral radiating apertures.

In an embodiment, the peripheral radiating apertures are regularly distributed around the axis of the central radiating aperture.

In an embodiment, the feed to the central radiating aperture is such that said central radiating aperture produces the most radiation.

In an embodiment, the feed means for the peripheral radiating apertures are such that the radiation produced by each of said peripheral radiating apertures is of practically the same intensity and less than the intensity of the radiation produced by the central radiating aperture.

In an embodiment, the radiation to be transmitted by the source has linear polarization in a particular direction and the feed means are such that each radiating aperture transmits radiation polarized in said particular direction which is oriented relative to the set of radiating apertures in such a manner as to maximize the uniformity of the radiation in three dimensions.

In an embodiment, the polarization direction is chosen so that a straight line segment in that direction passing through the center of the exit plane of the source passes through a minimum number of radiating apertures.

In an embodiment, the radiating apertures and the feed means are such that the intensity of the transmitted radiation at the periphery of the reflector is approximately 9 dB below the intensity of the transmitted radiation in the central part of the associated reflector.

In an embodiment, the Ka band is used for transmission and for reception.

In an embodiment, the transmit frequency is of the order of 20 GHz and the receive frequency is of the order of 30 GHz.

In an embodiment, the distance between the axes of two adjoining radiating apertures is of the same order as the wavelength of the transmitted radiation.

The present invention also provides a telecommunications system in which calls are relayed by antennas on board a satellite, in particular a geosynchronous satellite, the system including an antenna with radiating sources each of which is a radiating source of the type defined hereinabove.

BRIEF DESCRIPTION OF THE DRAWINGS

Other features and advantages of the invention will become apparent on reading the following description of embodiments of the invention, which is given with reference to the accompanying drawings, in which.

MORE DETAILED DESCRIPTION

The embodiment of the invention described with reference to the drawings is a transmit and receive radiating source 40 intended to be installed on board a geosynchronous satellite (not shown) constituting a relay for calls of a telecommunications system in a region 30 (FIG. 2) covering a large part of the European continent and part of the African continent. The region is divided into circular zones $\mathbf{32}_1$, $\mathbf{32}_2$, etc.

The whole of the region 30 is covered by the geosynchronous satellite (in orbit 36 000 km above the surface of the globe) with a cone of 6° total aperture. The angular distance (as seen from the satellite) between the centers of two adjoining zones is 0.5°.

In this example, where the total number of zones $\mathbf{32}_i$ is 48, the satellite includes four reflectors and each reflector is associated with 12 primary sources corresponding to non-adjacent zones.

Figure 1:
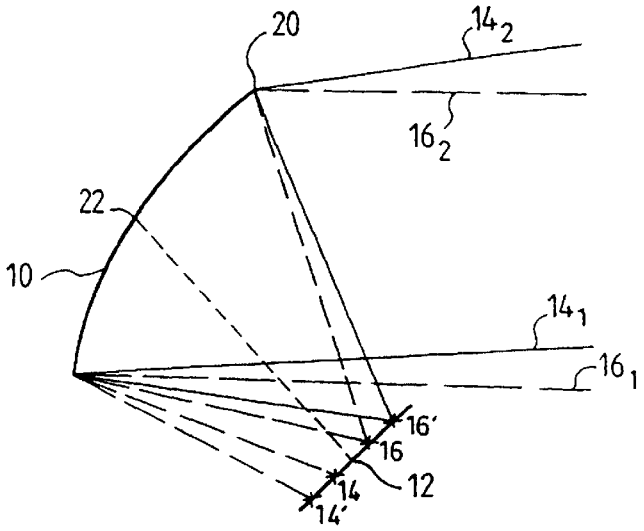
FIG. 1, already described, is a diagram of a reflector and radiating sources.
Figure 2:
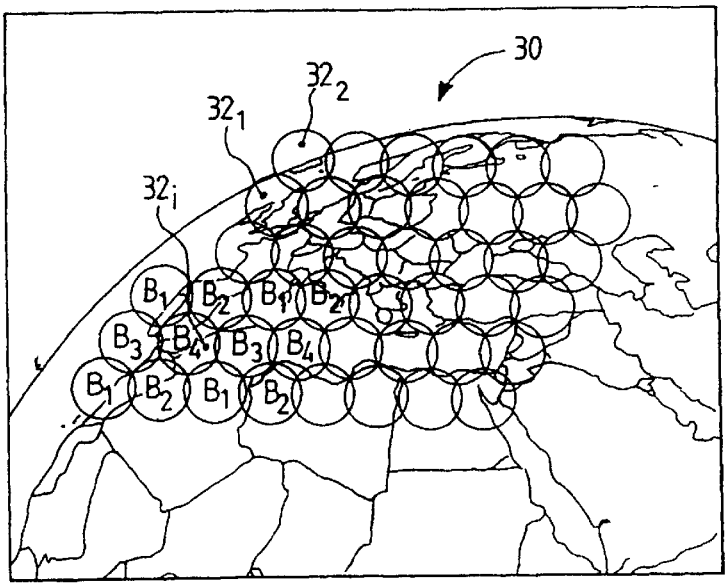
FIG. 2 is a map of a region showing zones covered by a geosynchronous satellite telecommunications system.

In the embodiment shown, each transmit and receive band is divided into four sub-bands B1, B2, B3 and B4 and each sub-band is used in 12 different zones. As shown in FIG. 2, two adjacent zones are allocated different sub-bands. Thus it can be seen that the zone $\mathbf{32}_i$, to which the sub-band B4 is allocated, is surrounded by zones to which the sub-bands B1, B2, B3 are allocated, but that the sub-band B4 is not allocated to any of the adjacent zones.

In this example the 12 radiating sources allocated to the same reflector correspond to the same transmit sub-band and the same receive sub-band.

In this example, the transmit frequency is 20 GHz and the receive frequency is 30 GHz.

In the invention, each primary radiating source 40 (FIG. 3) includes a plurality of radiating apertures $\mathbf{42}_1$, $\mathbf{42}_2$, . . . , $\mathbf{42}_7$ whose efficiency is at least equal to 70% and which open onto a plane 44. The radiating apertures are inscribed within a circle 46 in the plane 44 whose diameter is approximately 50 mm.

Accordingly, in this example, there are seven radiating apertures. The radiating aperture $\mathbf{42}_1$ is at the central position, i.e. its axis 48 is coincident with the axis of the circle 46, and the radiating apertures $\mathbf{42}_2$ to $\mathbf{42}_7$ are regularly distributed about the axis 48 in the same plane 44. In this example, all the axes of the radiating apertures $\mathbf{42}_1$ to $\mathbf{42}_7$ are parallel.

Each of the radiating apertures is associated with feed means $\mathbf{50}_1$ . . . $\mathbf{50}_7$ of variable amplitude and phase. The transmit and receive feeds are such that the illumination at the periphery of the reflector 10 is practically constant and approximately 9 dB below the illumination of the central part 22 of the reflector 10.

Thus each of the transmit and receive radiating apertures is fed in such a way as to obtain a chosen distribution of illumination between the central part and the periphery.

Each radiating aperture is also fed in such a way as to obtain substantially the same radiation pattern for transmission and reception. In this case the transmit and receive radiating apertures are fed differently.

The large number of radiating apertures, and therefore the large number of corresponding feeds, facilitates optimizing the radiation pattern. The large number of feeds constitutes a degree of freedom enabling this result to be obtained, by virtue of the fact that each feed can be selected individually.

More generally, the plurality of feeds of the radiating apertures means that the transmit and receive patterns can be chosen at will and independently of each other. In other words, the transmit and receive patterns are not necessarily identical; they can be chosen in accordance with the various constraints imposed on the antenna.

Figure 4:
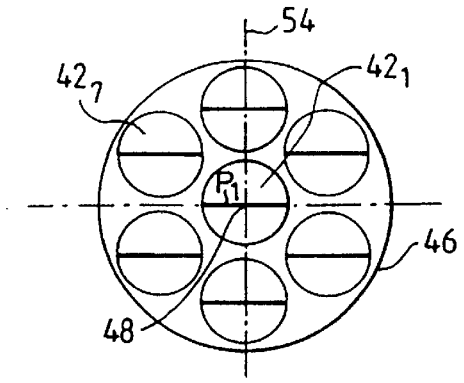
FIG. 4 is a diagram showing one mode of feeding the source shown in FIG. 3, and FIGS. 5 and 6 are graphs illustrating properties of the source shown in FIG. 3.

What is more, in the embodiment shown in FIG. 4, the direction of polarization (which is the same for the radiating apertures $\mathbf{42}_1$, $\mathbf{42}_2$, etc.) of the feed of the radiating apertures compensates at least the greater part of the individual lack of symmetry in three dimensions of each of the radiating apertures. In this embodiment, each radiating aperture 42 has a pattern which is not circularly symmetrical about its axis, but which is instead more directional in the polarization direction P than in the perpendicular direction. Providing a plurality of such radiating apertures distributed inside the circle 46 provides intrinsic compensation of the lack of individual symmetry of the pattern of each radiating aperture 42 without taking special precautions.

What is more, choosing the polarization direction relative to the distribution of the radiating apertures further improves the uniformity of the radiation pattern about the axis 48.

Thus, in the example shown, the polarization direction $P_1$ corresponds to a direction for which the straight line segment in that direction passing through the axis 48 passes through only the central radiating aperture $42_1$ and the parallel straight line segments passing through the centers of the other radiating apertures in the plane 44 are regularly distributed on either side of the axis $P_1$. Clearly, this distribution is preferable in terms of making energy distribution more uniform over polarization in the perpendicular direction, i.e. along the straight line segment 54 passing through the center 48, in which case three radiating apertures would lie along that axis and would not contribute to obtaining uniformity on either side of the axis 54.

Thus, in this example, in order to select the direction of polarization of the radiation, the direction passing through the center 48 and the maximum number of centers of the radiating apertures is determined and a polarization direction which is perpendicular to that direction is chosen.

In the plane 44, the radius of each radiating aperture 42 is approximately 16 mm, which is one wavelength at 20 GHz. This suppresses the lobes formed by the set of radiating apertures $42_1$ to $42_7$.

In this example, correct operation is obtained by feeding the central radiating aperture $42_1$ with a particular power and feeding the peripheral radiating apertures $42_1$ to $42_7$ with a given power lower than the particular power fed to the radiating aperture $42_1$.

The source 40 according to the invention has the same polarization purity, pass-band, and symmetrical radiation pattern properties as conventional sources with corrugated radiating apertures. However, compared to that prior art solution, the source 40 has the further advantage of minimizing losses by spillage outside the reflector and of providing a level of illumination of the reflector which is practically the same for transmission and reception. What is more, the source of the invention is less complex to fabricate than a corrugated radiating aperture, because fabricating a high-efficiency radiating aperture 42 is simpler than fabricating a corrugated radiating aperture, whose efficiency is at most equal to 60% and which requires great precision in the design of the ribs.

Figure 3:
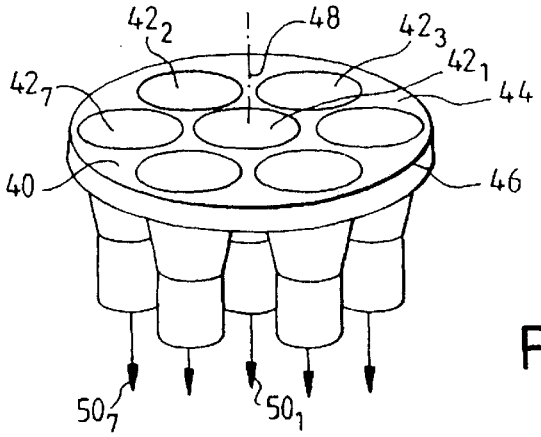
FIG. 3 shows an embodiment of a primary source according to the invention.
Figure 5:
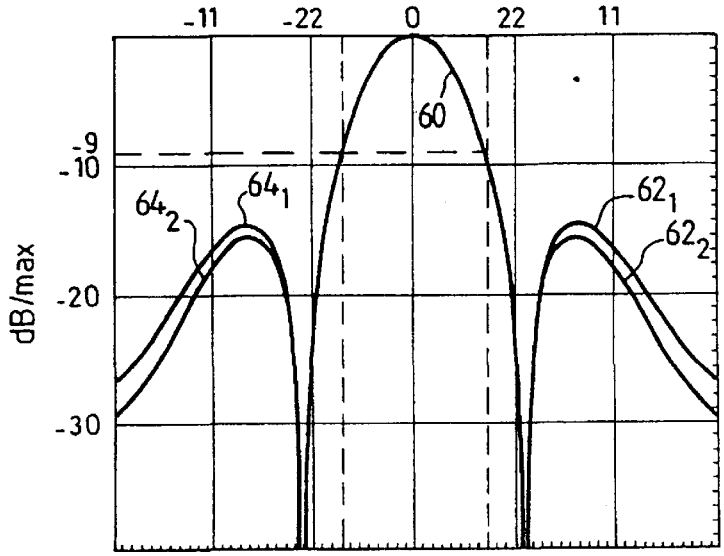

FIG. 5 shows the transmit (20 GHz) radiation pattern of the radiating source 40 shown in FIGS. 3 and 4. Angular aperture is plotted along the abscissa axis and amplitude of radiation on the 0° axis is plotted up the ordinate axis, expressed in dB relative to the maximum value.

Curve 60 corresponds to the central lobe, curves $62_1$ and $64_1$ represent secondary lobes in the polarization plane, and curves $62_2$ and $64_2$ represent secondary lobes in the direction perpendicular to the polarization. There is no difference between the polarization direction and the perpendicular direction for the central lobe 60. The curve shows that for a 38° aperture, which corresponds to the illumination of the reflector 10, the attenuation is −9 dB, which complies with the specifications, and the external energy loss is therefore negligible. Other things being equal, with a corrugated radiating aperture, the attenuation for a 38° aperture would be −3 dB.

Figure 6:
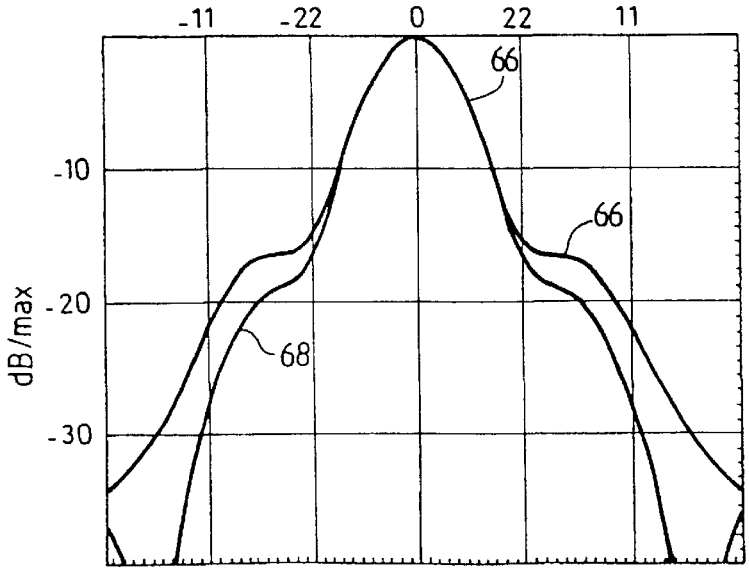

FIG. 6 is analogous to FIG. 5. It shows the receive (30 GHz) radiation pattern for the radiating source 40. Curve 66 corresponds to the polarization direction and curve 68 corresponds to the perpendicular direction. Within the usable (38°) aperture, the curves 66 and 68 coincide. It can also be seen that within the usable aperture the pattern 66 is practically the same as the transmission pattern 60 shown in FIG. 5.

The invention is not limited to the embodiments described, of course. Thus the number of radiating apertures is not limited to seven. There can be more or fewer radiating apertures.

What is claimed is:

1. A radiating source for transmitting and receiving at different frequencies, installed on board a satellite to define a radiation pattern in a terrestrial zone, said source being disposed at or near the focal plane of a reflector associated with other sources corresponding to other terrestrial zones, the source comprising:

a plurality of radiating apertures, each of which has an efficiency at least equal to 70%; and feed means for feeding each radiating aperture, the radiating apertures and their feed means being such that the energy radiated by all of the radiating apertures is practically limited to a corresponding reflector, at least for transmission.

2. A source according to claim 1, wherein the radiating apertures are fed differently for transmission and for reception.

3. A source according to claim 1, wherein the feed means for each radiating aperture are such that the radiation pattern is substantially the same for transmission and for reception.

4. A source according to claim 1, including a central radiating aperture and peripheral radiating apertures.

5. A source according to claim 4, wherein the peripheral radiating apertures are regularly distributed around the axis of the central radiating aperture.

6. A source according to claim 4, wherein the feed to the central radiating aperture is such that said radiating aperture produces the most radiation.

7. A source according to claim 6, wherein the feed means for the peripheral radiating apertures are such that the radiation produced by each of said peripheral radiating apertures is of practically the same intensity and less than the intensity of the radiation produced by the central radiating aperture.

8. A source according to claim 1, wherein the radiation to be transmitted by the source has linear polarization in a particular direction and the feed means are such that each radiating aperture transmits radiation polarized in said particular direction, which is oriented relative to the set of radiating apertures in such a manner as to maximize the uniformity of the radiation in three dimensions.

9. A source according to claim 8, wherein the polarization direction is chosen so that a straight line segment in that direction passing through the center of the exit plane of the source passes through a minimum number of radiating apertures.

10. A source according to claim 1, wherein the radiating apertures and the feed means are such that the intensity of the transmitted radiation at the periphery of the reflector is approximately 9 dB below the intensity of the transmitted radiation in the central part of the associated reflector.

11. A source according to claim 1, wherein a Ka band is used for transmission and for reception.

12. A source according to claim 11, wherein the transmit frequency is of the order of 20 GHz and the receive frequency is of the order of 30 GHz.

13. A source according to claim 1, wherein the distance between the axes of two adjoining radiating apertures is of the same order as the wavelength of the transmit radiation.

14. A telecommunications system in which calls are relayed by antennas on board a satellite, the system comprising an antenna with radiating sources each of which is a radiating source comprising:

a plurality of radiating apertures, each of which has an efficiency at least equal to 70%; and feed means for feeding each radiating aperture, the radiating apertures and their feed means being such that the energy radiated by all of the radiating apertures is practically limited to a corresponding reflector, at least for transmission.

15. A telecommunication system according to claim 14, wherein the satellite is a geosynchronous satelite.

* * * * *